United States Patent [19]

Roberts

[11] 4,237,849

[45] Dec. 9, 1980

[54] FUEL PRESSURE REGULATOR

[76] Inventor: Albert S. Roberts, Star Route, Rector, Pa. 15677

[21] Appl. No.: 890,148

[22] Filed: Mar. 27, 1978

[51] Int. Cl.[3] ..... F02M 39/00

[52] U.S. Cl. ..... 123/513; 123/511; 261/36 A; 137/115

[58] Field of Search ..... 123/136, 139 AV; 261/36 A; 137/115

[56] References Cited

U.S. PATENT DOCUMENTS

| | | | |
|---|---|---|---|
| 2,182,933 | 12/1939 | Schimanek | 123/136 |
| 2,714,501 | 8/1955 | Sellers | 261/36 A |
| 2,737,167 | 3/1956 | Dickey | 123/139 AV |
| 3,061,286 | 10/1962 | Mennesson | 261/36 A |
| 3,302,935 | 2/1967 | York, Jr. | 261/36 A |
| 3,520,320 | 7/1970 | Crawford et al. | 137/115 |
| 3,955,396 | 5/1976 | Carrieri | 137/115 |

*Primary Examiner*—Charles J. Myhre
*Assistant Examiner*—Magdalen Moy
*Attorney, Agent, or Firm*—Albert L. Jeffers; Roger M. Rickert

[57] ABSTRACT

A pressure regulator for use in a fuel supply system such as might be found in a vehicle where fuel from a fuel tank is conveyed by a fuel pump to a carburetor is disclosed. The pressure regulator maintains the fuel pressure at the fuel pump outlet at a preferred level relative to atmospheric pressure and includes a regulator housing with a fuel inlet coupled to the fuel pump outlet and a fuel outlet coupled to the fuel system upstream of the fuel pump. A first pressure responsive surface such as a piston or diaphragm surface within the regulator is exposed to and actuable by fuel pressure at the regulator fuel inlet and a second pressure responsive surface having an area greater than the first surface is actuable by ambient atmospheric pressure with the two surfaces being coupled for conjoint movement to a position which adjusts fuel flow between the regulator inlet and outlet so long as the ratio of fuel pressure to atmospheric pressure is less than a preselected value while movement from that position to allow fuel flow between the inlet and outlet occurs when the ratio of fuel pressure to atmospheric pressure exceeds the preselected value. Typically the preselected value is numerically the ratio of the area of the second atmospheric pressure actuated surface to the area of the first or fuel actuated surface.

4 Claims, 6 Drawing Figures

FUEL PRESSURE REGULATOR

BACKGROUND OF THE INVENTION

The present invention relates generally to the regulation of the pressure within a feed system such as a fuel supply system and more particularly to a fuel pressure regulator for maintaining the pressure at a fuel pump outlet at a preferred level relative to the ambient air pressure.

One conventional fuel supply system, for example as may be found in an automobile, employs a conduit or pipe leading from a fuel reservoir or fuel tank, passing through a fuel filter and an engine or electrically driven fuel pump, and by way of a further conduit to a float bowl or reservoir in the carburetor. Frequently, such carburetor reservoirs employ a float which maintains the level of fluid within that reservoir constant. In these constant head type fuel systems, the fuel pump may be of the diaphragm type and when the carburetor fuel chamber is filled, a float valve closes in the carburetor, creating a back pressure in the fuel pump chamber, so that the fuel pump diaphragm is no longer actuated to supply further fuel. This disabling of the fuel pump is typically due to the fact that the diaphragm is spring actuated in one direction and actuated in the other direction by an eccentric or cam type arrangement and when the carburetor float valve closes and the pressure increases within the fuel pump, the diaphragm is forced against the spring by that pressure with the pressure being sufficiently high to hold the spring in that position.

While such a float controlled or constant head fuel supply system is quite successful in many applications, diaphragm type constant pressure fuel supply systems have also been devised, for example, for stunt aircraft, where a conventional float supply system would not be satisfactory. Such a constant pressure fuel supply device would have an inlet coupled to a fuel pump and an outlet coupled to the carbureting device. The pressure regulator has a diaphragm actuated valve which blocks the fuel inlet so long as the fuel pressure within the regulator is sufficient to maintain a spring which urges the diaphragm in a direction opposite to that which it is urged by the fuel pressure compressed. If the fuel pressure drops sufficiently, the spring forces the diaphragm to move, opening the valve and allowing additional fuel into the regulator from the fuel pump, thus maintaining a constant fuel pressure at the regulator fuel outlet. Such a fuel pressure regulator controls the fuel pressure in the carburetor by selectively blocking or unblocking the fuel pump outlet, and either this system or the previously mentioned conventional float system may be plagued by leakage problems since when the fuel pump output is effectively disabled, relatively high fuel pressures exist within the system, making the probability of fuel leakage much greater.

The success of any carburetor design is dependent upon its fuel metering system and variations in the fuel supply pressure to that metering system will vary the metering system from optimum. Such variations may be simply due to atmospheric changes or changes in the elevation of the system or in the case of a float type supply, splashing and disruption of the desired level may occur either due to the system not being maintained in the proper attitude or due to acceleration of the system.

SUMMARY OF THE INVENTION

Among the several objects of the present invention may be noted the provision of a well regulated low pressure fuel supply system; the provision of a fuel supply system in which the probability of fuel leakage is reduced; the provision of a fuel supply system which is self-compensating for ambient pressure changes either of the conventional atmospheric type or due to extreme changes in elevation; the provision of a pressure regulator which stabilizes the fuel pressure immediately prior to the fuel metering arrangement; and the provision of a differential pressure regulator for supplying fuel at a low and relatively constant pressure to a carbureting arrangement. These as well as other objects and advantageous features of the present invention will be in part apparent and in part pointed out hereinafter.

In general and in one form of the invention, a pressure regulator maintains the fuel pressure at the fuel pump outlet at a preferred level relative to the ambient atmospheric pressure by selectively short-circuiting the fuel pump outlet back into the fuel system upstream of that fuel pump when the pump output pressure is a prescribed amount in excess of the atmospheric pressure. The regulator includes a first pressure responsive surface within a housing which surface is exposed to and actuable by the fuel pressure at the regulator fuel inlet as well as a second pressure responsive surface which is actuable by atmospheric pressure. The first and second surfaces are coupled together for conjoint movement to a first position which precludes fuel flow between the regulator inlet and the regulator outlet, which outlet is coupled back into the fuel system upstream of the pump, so long as the ratio of fuel pressure to atmospheric pressure is less than a prescribed value while those two surfaces move to allow fuel flow from the fuel inlet around the fuel pump and back into the fuel system upstream of the fuel pump when the ratio of fuel pressure to atmospheric pressure exceeds the preselected or prescribed value. This preselected value is approximately the ratio of the area of the second or atmospheric pressure sensing surface to the area of the first surface.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENTS

Figure 1:
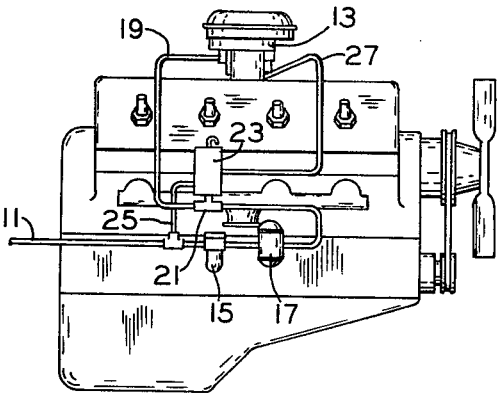
FIG. 1 is a side somewhat schematic illustration of a vehicle fuel system and associated vehicle engine.

Referring now to the drawings and particularly to FIG. 1, the vehicle fuel supply system includes a fuel line 11 which supplies fuel from a fuel tank (not shown) to a carburetor 13 by way of a fuel filter 15 and an engine driven fuel pump 17 by way of fuel line 19. Fuel line 19 includes a T-connector 21 with one branch of the T leading to a pressure regulator 23. Regulator 23 also has a fuel outlet which, by way of line 25, selectively returns the fuel to the fuel supply line upstream of the fuel pump 17 and further includes a vacuum connection by way of line 27 to a conventional vacuum connection of the type, for example, employed for actuating windshield wipers and the like at the base of carburetor 13. Pressure regulators, suitable for direct incorporation in the fuel system illustrated in FIG. 1, are shown in subsequent Figures.

Figure 2:
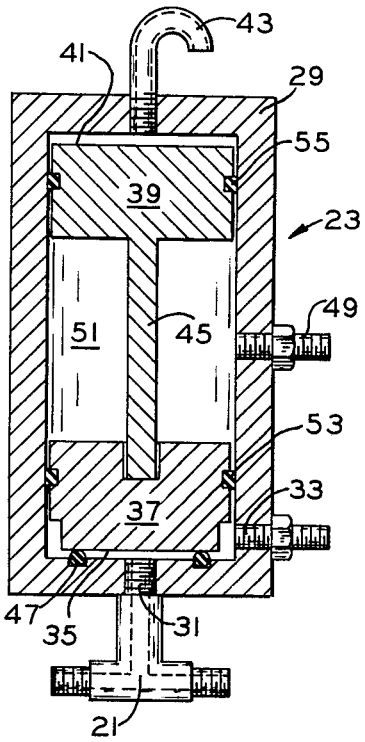
FIG. 2 is a cross-section view of a pressure regulator for maintaining the fuel pump outlet pressure at a preferred level relative to atmospheric pressure.

In FIG. 2, the pressure regulator 23 includes a regulator housing 29 having a fuel inlet 31 coupled by way of T 21 to the fuel pump outlet. The housing 29 also has a fuel outlet 33 for connection by way of line 25 to the fuel system upstream of the fuel pump. Within the regulator housing 29, a first pressure responsive surface 35 is exposed to and actuable by fuel pressure. This first pressure responsive surface is the lower face of a piston 37. Also within the housing 29 is located a second piston 39 which has its upper face 41 actuable by atmospheric pressure as supplied thereto by a vent 43. Pistons 37 and 39 are coupled together by a rigid member 45 for conjoint movement between the position illustrated in which piston 37 sealingly engages O-ring 47 to preclude fuel flow between the fuel inlet 31 and the fuel outlet 33 with this position being maintained so long as the ratio of fuel pressure to atmospheric pressure is less than a preselected value. When the upwardly urging force due to the fuel pressure on surface 35 exceeds the downwardly urging force due to the atmospheric pressure on surface 41, both pistons 37 and 39 move upward, breaking the seal between surface 35 and O-ring 47 and allowing fuel pressure to bleed by way of outlet 33 and pipe 25 back to the fuel reservoir. A bidirectional valve, movable membrane or the like, might be provided in conjunction with the vent 43 to prevent dirt entering the regulator, while still conveying the ambient atmospheric pressure to the second surface 41.

The preselected value at which surface 35 raises from O-ring 47 occurs when the downward and upward forces on the pistons 37 and 39 equal one another and is the ratio of the area of surface 41 to the area of the first surface 35. Stated differently, the product of the atmospheric pressure and the air pressure responsive surface area equals the product of the fuel pressure and the fuel pressure responsive area.

The regulator of FIG. 2 also includes a connection 49 which may be coupled by way of tube 27 to a vacuum source on the engine, thereby creating within the region 51, and therefore also on the lower surface of piston 39 and the upper surface of piston 37, a pressure which is different from atmospheric pressure and different from the fuel pressure. This low pressure region is sometimes useful in stabilizing regulator operation and while the resultant effect of the pressure within region 51 in the embodiment of FIG. 2 is zero, such is not the case in the regulator illustrated in FIG. 3. Sealing rings, such as 53 and 55, may be provided as desired.

Figure 3:
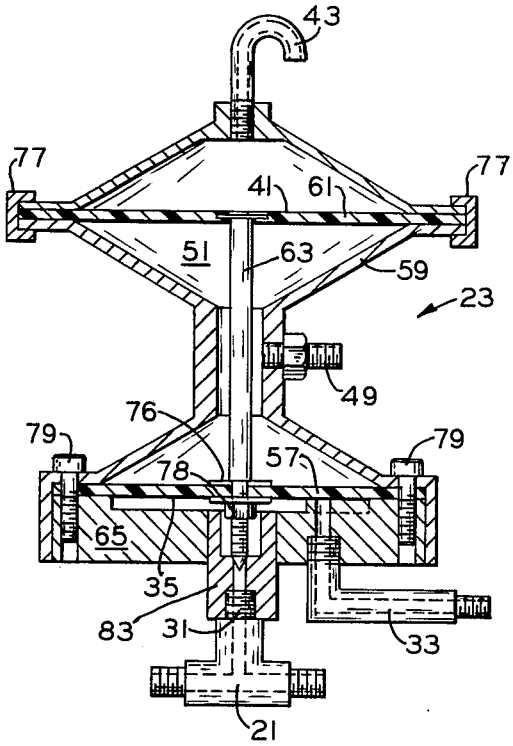
FIG. 3 is a view in cross-section of a pressure regulator which eliminates the moving pistons associated with the regulator of FIG. 2.

In FIG. 3, the first pressure responsive surface 35 now comprises a lower surface of a diaphragm 57 with that diaphragm peripherally mounted for flexure within the housing 59. Similarly, the second pressure responsive surface 41 comprises one surface of a second diaphragm 61 which is also peripherally mounted for flexure within the housing 59. The two diaphragms are coupled by a threaded rod 63 which rigidly interconnects a central portion of each diaphragm so that the two diaphragms flex in unison. As before, the region 51 within the housing and between the opposite diaphragm surfaces may be subjected to a pressure which is different from atmospheric pressure as applied to surface 41 and different from fuel pressure as applied to surface 35. With this intermediate pressure being the pressure within the carburetor throat at the conventional vacuum connection which varies under different engine loading conditions, the ratio of fuel pressure to atmospheric pressure at which the valve opens, will now vary according to the engine loading conditions.

The valve or regulator of FIG. 3 remains closed with diaphragm surface 35 sealing against member 65 and preventing any fuel bypass until the fuel pressure as exerted on that surface 35 exceeds the air pressure times the surface area on which that air pressure is exerted, at which time rod 63 moves upwardly with both diaphragms flexing, thereby allowing a fuel flow between the inlet 31 and bypass outlet 33, as before.

Figure 4:
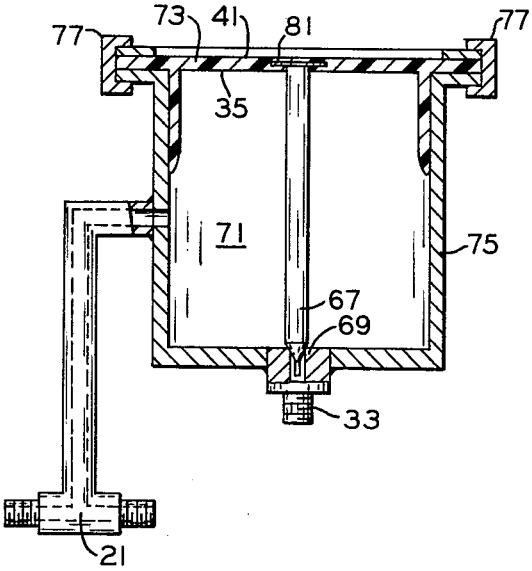
FIGS. 4, 5 and 6 are views of other pressure regulators according to the present invention.

In FIG. 4, the pressure of the fuel within the T-connection 21 is reduced by bleeding fuel from regulator outlet 33 back to the fuel reservoir when needle valve 67 raises from its seat 69. With the pressure regulator of FIG. 4, the entire interior region 71 may be filled with fuel or that region may contain some trapped air but in either event, the lower surface 35 of a diaphragm 73 is subjected to fuel pressure while the upper surface 41 of diaphragm 73 is subjected to air pressure. Diaphragm 73 is sealed to the regulator housing 75 and if diaphragm 73 is allowed to flex, only at its outer periphery, the area 41 which is subjected to air pressure may be made greater than the area 35 which is subjected to fuel pressure and the valve will open to bleed off excessive fuel pressure when the product of the fuel pressure and the fuel responsive area is equal to the product of the air pressure and the air responsive area, as before.

Numerous modifications within the scope of the present invention should now be apparent. For example in FIG. 2, the lower portion of the cylinder wall may be of a lesser diameter than the upper portion of the cylinder wall, whereby piston 37 would be of a lesser diameter to give any desired ratio of areas responsive to air pressure, the carburetor vacuum, as well as the fuel line pressure. Further, connecting rod 45 may merely loosely engage piston 37 so that, for example, in the case of an engine backfire and increase of pressure within the region 51, only piston 39 would be urged upwardly while piston 37 would remain in its closed position. In FIG. 3, the entire regulator housing could, if desired, be fabricated of relatively inexpensive molded plastic parts with the housing portions being joined adhesively, thermally or by the relatively simple U-shaped clips, such as 77, as illustrated. Of course, these housing portions could be joined by threaded fasteners in the manner illustrated by bolt 79. The base member 65, which is a flat plastic member, could of course be fastened to the remaining housing portions, either by spring clips, bolts or adhesive or thermal techniques, as desired. Still further, diaphragms, such as 57, might be fabricated of elastomer materials which would aid the sealing between that diaphragm and the valve porting plate 65. As an adjunct to or in lieu of the direct sealing of the diaphragm 57 against the outlet port in the plastic member 65, rod 63 might have at the lower end thereof a needle valve arrangement which would seat against a valve seat 83, much the same as is described earlier with respect to FIG. 4. In FIGS. 3 and 4, respective rods 63 and 67 are connected to diaphragms 61 and 73. While rod 63 is connected to diaphragm 57 by nut 78 and washer 76, and diaphragms 73 and 61 have a relatively flat head 81 embedded therein, either connecting feature is applicable to either Figure depending upon the choice of materials for the respective diaphragms.

Figure 5:
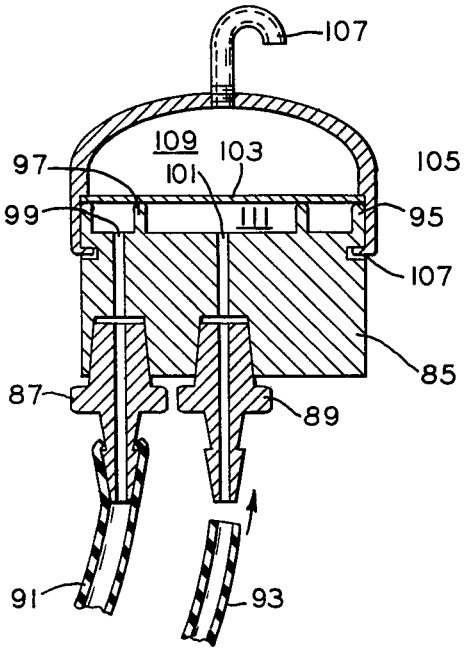

In FIG. 5, there is illustrated a pressure regulator which incorporates the previously discussed features in an extremely economical form. A plastic body 85 which forms the bottom of the regulator housing threadingly receives a pair of fittings 87 and 89 to which flexible tubing portions 91 and 93 may be attached. The flexible tubing portion 91 connects back upstream of the fuel pump as did conduit 25 in FIG. 1, while the flexible tubing portion 93 connects to a T 21 in the line between the fuel pump and the carburetor.

Figure 6:
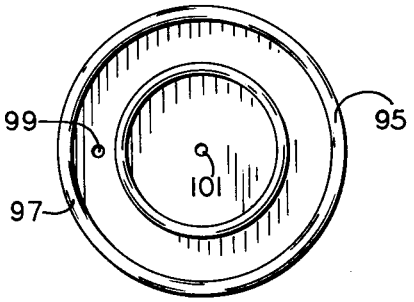

The upper portion of the base 85 is illustrated in a top view in FIG. 6 and is seen to include an outer raised annular portion 95 as well as an inner raised annular portion 97. Between the outer and inner annuli is opening 99 which connects to the pressure relief line 91 to return fuel to the upstream side of the fuel pump. Opening 101 which is disposed inside the inner annulus 97 connects by way of fitting 89 and tubing 93 to the T, such as 21 in FIG. 1. A diaphragm 103 is urged downwardly into contact with annulus 95 by a cap or upper housing portion 105 which has near the top thereof a vent 107 to the atmosphere. Base 85 may be provided with a series of notches, and cap 105 provided with a corresponding series of hooks, as at 107, to securely fasten the two housing portions together, or those housing portions may be joined by other convenient arrangements.

So long as the pressure within the region 109 times the diaphragm area, which is that area within the annulus 95, on which that atmospheric pressure acts, is at least as large as the fuel pressure within region 111 times the area within annulus 97, on which that pressure acts, the diaphragm continues to seal against annulus 97 and no pressure relief function is provided. When the fuel pressure becomes sufficient to raise diaphragm 103 slightly, fuel will leak between annulus 97 and the diaphragm to be returned by way of the opening 99 to a location in the fuel supply system upstream from the fuel pump.

The present invention may be employed to eliminate a spring regulated relief valve and its associated spring lag as well as to decrease system pressure, thereby avoiding leakage as well as improving fuel flow from the carburetor into the engine. For example, a typical fuel pump may operate somewhere between seven and fifteen pounds per square inch above atmospheric pressure and the regulator of the present invention may reduce this pressure of the fuel as it enters the carburetor to perhaps as low as twelve to fourteen pounds per square inch absolute pressure since of course the pressure within the carburetor throat is substantially lower than atmospheric pressure.

From the foregoing it is now apparent that a novel fuel pressure regulator has been disclosed meeting the objects and advantageous features set out hereinbefore as well as others, and that modifications as to the precise configurations, shapes and details may be made by those having ordinary skill in the art without departing from the spirit of the invention or the scope thereof as set out by the claims which follow.

What is claimed is:

1. A pressure regulator for a vehicle fuel system having a fuel tank, a carburetor, a fuel pump, first means coupling the fuel tank to a fuel pump inlet, and second means coupling a fuel pump outlet to the carburetor, said pressure regulator maintaining the fuel pressure at the fuel pump outlet at a preferred level relative to atmospheric pressure and comprising:

a regulator housing having a fuel inlet for coupling to the fuel pump outlet, and a fuel outlet for coupling to the fuel system upstream of the fuel pump;

a diaphragm peripherally supported by the housing with one diaphragm surface comprising a pressure responsive surface exposed to and actuable by fuel pressure at the fuel inlet and another diaphragm surface exposed to and actuable by atmospheric pressure, the diaphragm being flexible between a first position to preclude fuel flow between the fuel inlet and the fuel outlet so long as the ratio of fuel pressure to atmospheric pressure is less than a preselected value and another position to allow fuel flow from the fuel inlet to the fuel outlet when the ratio of fuel pressure to atmospheric pressure exceeds the preselected value.

2. The pressure regulator of claim 1 including means limiting the area of the pressure responsive surface exposed to fuel pressure when the diaphragm is in the first position to less than the area of the another diaphragm surface exposed to atmospheric pressure.

3. The pressure regulator of claim 1 wherein the ratio of the area of the another diaphragm surface to the area of the pressure responsive surface exposed to fuel pressure is the preselected value.

4. The pressure regulator of claim 1 wherein fuel flows between the regulator fuel inlet and fuel outlet and then to the first means only during times of excessive fuel pressure, fuel flow from the fuel pump to the carburetor completely bypassing the regulator.

* * * * *